US006009813A

United States Patent [19]

Britzke

[11] Patent Number: 6,009,813

[45] Date of Patent: Jan. 4, 2000

[54] CONNECTION BETWEEN TWO VEHICLES HINGED TO ONE ANOTHER, E.G. RAILWAY COACHES OR UNDERGROUND COACHES

[75] Inventor: Ingo Britzke, Kassel, Germany

[73] Assignee: Hubner Gummi - Und Kunststoff, Kassel, Germany

[21] Appl. No.: 09/223,251

[22] Filed: Dec. 30, 1998

Related U.S. Application Data

[63] Continuation of application No. PCT/DE96/01164, Jul. 1, 1996.

[51] Int. Cl.[7] ..... B60D 5/00

[52] U.S. Cl. ..... 105/8.1; 105/15; 105/18; 105/458

[58] Field of Search ..... 105/8.1, 15, 16, 105/17, 18, 21, 22, 458, 459

[56] References Cited

U.S. PATENT DOCUMENTS 5,775,232 7/1998 Golemis et al. ..... 105/458

FOREIGN PATENT DOCUMENTS 206583A 4/1986 European Pat. Off. ..... 105/17
0206583 12/1986 European Pat. Off. .

*Primary Examiner*—Robert J. Oberleitner
*Assistant Examiner*—Robert J. McCarry, Jr.
*Attorney, Agent, or Firm*—Thomas R. Vigil

[57] ABSTRACT

The invention relates to a connection between two vehicles hinged to one another, e.g. railway coaches or underground coaches, whereas the connection comprises a bellows and an intercommunicating gangway, whereas the connection may be divided transversely to the longitudinal axis of the vehicle into two connection sections, the one forming the bellows section and the other the gangway section (30, 10), whereas each connection section (1) is held by tension means (40) hinged on the coach body (60) of the vehicle and the intercommunicating gangway section (10) is designed as an articulated gangway section.

16 Claims, 4 Drawing Sheets

CONNECTION BETWEEN TWO VEHICLES HINGED TO ONE ANOTHER, E.G. RAILWAY COACHES OR UNDERGROUND COACHES

This application is a continuation of National Stage PCT/DE96/01164 filed Jul. 1, 1996.

BACKGROUND OF THE INVENTION

1. Field of the Invention

The present invention relates to a connection between two vehicles hinged to one another, e.g. railway coaches or underground coaches, whereas the connection comprises a bellows and an intercommunicating gangway, whereas the connection may be divided transversely to the longitudinal axis of the vehicle into two connection sections, the one forming the bellows section and the other the gangway section, whereas each connection section is held by tension means hinged on the coach body of the vehicle.

2. Description of the Prior Art

A connection of the type mentioned above is known out of EPA 0 206 583. The bellows and the gangway are hereby preferably divided into two identical halves with central frame, whereas the central frames are held by tension means on the body coach. The gangway itself consists on two sheet metals maintained by the central frames. The disadvantage thereof is that, while turning a curve, the configuration of the gangway consisting in two sheet metals is widening in the area where the two sheet metals are overlapping, so that splits may occur.

SUMMARY OF THE INVENTION

The object of the invention is therefore to provide a connection of the type mentioned above allowing to turn even sharp curves without the risk of splits forming in the area of the gangway.

The solution of the invention is to design the intercommunicating gangway section as an articulated gangway section. By designing the gangway or the gangway section respectively as an articulated gangway, the individual members of the gangway are widening evenly in sharp curves, so that an essentially continuous surface may be upheld.

According to another characteristic of the invention, the traction means are arranged diagonally from the top of the coach body downwards to the bellows' underside, running along the bellows' side wall on the connection section or on the coach body. Such a traction means may guarantee a secure and stable bedding of a divided connection, even if it happens to be very long, as may particularly be the case when, in sharp curves, a big extension is required from the bellows.

Each bellows side and more particularly each bellows section is provided with two separate traction means. According to an advantageous characteristic of the invention, the length of the traction means, which has for example been given the shape of a rod, may be changed in order to achieve an accurate adjustability of the rod's length. According to another characteristic of the invention it also has an elastic and flexible intermediate member in order to be able in curves to yield on the outer side of the curve according to the extension of the bellows.

The two bellows halves or bellows sections may be linked together on their center by means of a central frame consisting in two coupling frames, whereas the coupling frames may be coupled to one another. The traction means may be hinged on this central frame or on the two coupling frames.

Since, according to another characteristic of the invention, the gangway section is rotatably receivable by the coupling frame, not only the bellows section, but the complete gangway section is held by the traction means. When the gangway section is borne by the coupling frame, the gangway section is provided with a bearing shell in the area of the coupling frame, whereas the coupling frame is provided with a mandrel receiving the bearing shell.

According to another characteristic of the invention, the contracted bellows section may be tentered and fastened by a holding member when the central frame is separate. In the simplest case, the holding member is consisting in a hook that is positively locking a bolt accomodated on one of the frame parts in the way of a catch lock.

When the connection is divided, the also divided sections of the intercommunicating gangway may be tilted upward.

The coach body of the vehicle part has furthermore been provided with a chamber for the slidable reception of the intercommunicating gangway, whereas the intercommunicating gangway has a cradle at its end which is slidably guided in the chamber. In order to prevent the cradle from jamming in the chamber, the cradle is provided with rollers having a vertically running axis, said rollers ensuring the lateral guidance within the chamber.

In order to guarantee that, after having turned a curve, the intercommunicating gangway is reintegrating its original position, it has been seen to it that the cradle is slidably guided in the chamber against a spring's force. The intercommunicating gangway has furthermore to be able to yield to all occurring travelling motions, and more particularly to all occurring swaying and nodding movements. Therefor, the articulated gangway has stepping and gliding members, whereas the gliding members may be received by the stepping members so as to be slidable relative to said stepping members. This means that, when the intercommunicating gangway is telescoped, which is the case in S-curves, each and everyone of the gliding members is nearly completely covered by two stepping members. When the intercommunicating gangway is extended, the gliding members become visible.

The gliding and stepping members are kept in place in frame stretchers running parallel to the longitudinal axis of the vehicle. The gliding and stepping members are borne so that they may be received in vertical direction in an elastic and flexible way by the frame stretchers. Thus they are able to yield to the corresponding swaying movements of the vehicle parts.

As a whole, an intercommunicating gangway of the type mentioned above is relatively easy and thus cheap to mount. Thanks to its simple structure it is only little prone to failure, which favors the use of such an intercommunicating gangway, particularly in developing countries. The invention is explained in more details according to the drawing.

DESCRIPTION OF THE PREFERRED EMBODIMENT(S)

Figure 1:
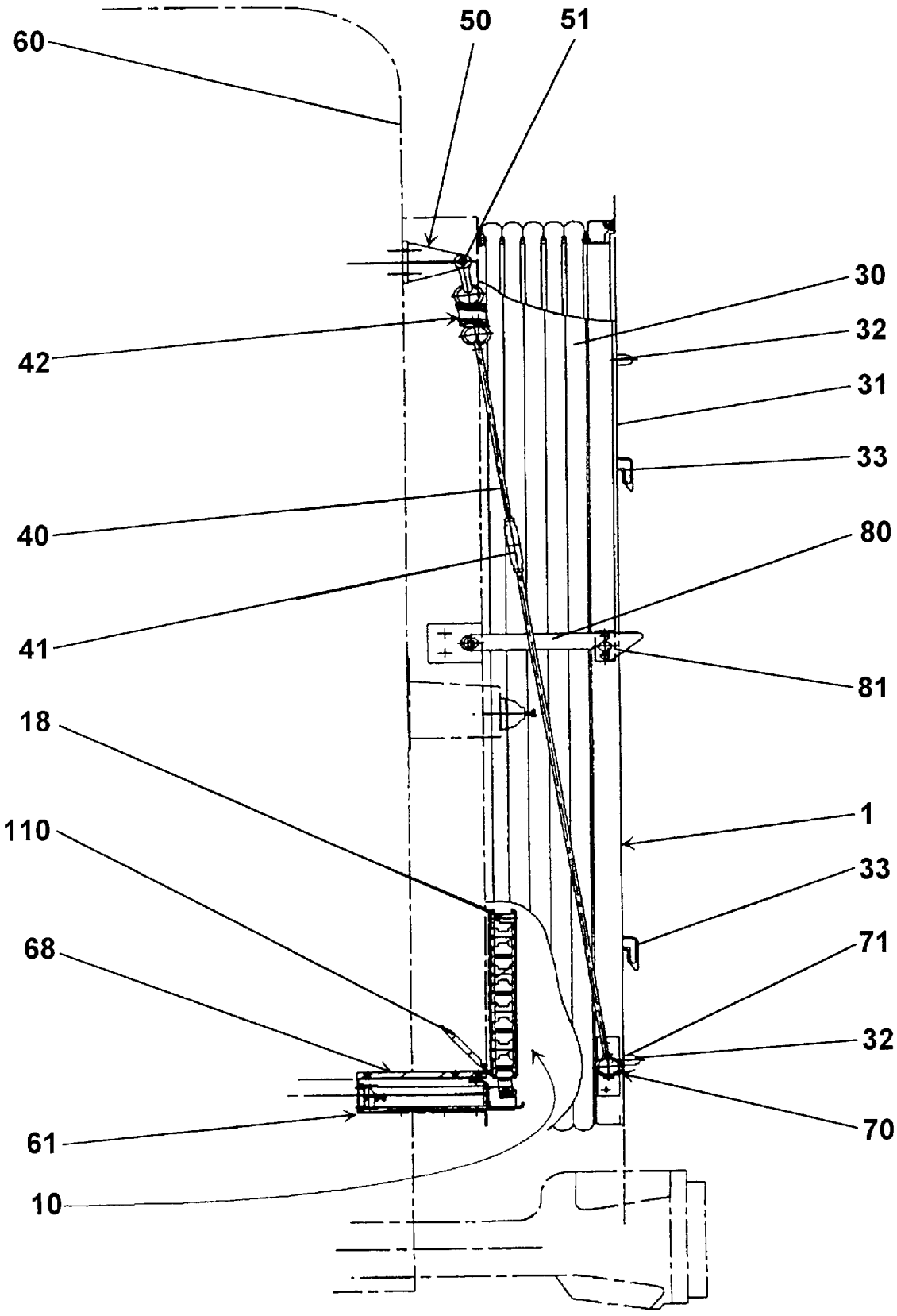
FIG. 1 is a lateral view of a section of a connection.

Referring to FIG. 1, the connection section referred to as a whole with numeral 1 comprises the intercommunicating gangway section referred to with numeral 10 and the bellows section referred to as a whole with numeral 30. The one bellows section 30 is provided, in its area of transition to the other bellows section 30, with two coupling frames 31 forming the central frame. The bellows section 30 is held by the rod 40, which is arranged on one side at 50 on the coach 60 and on the other side at 70 on the coupling frame 31. The rod itself has a turnbuckle 41 with the help of which the length of the rod may be changed as well as an elastic and flexible intermediate member 42 being designed for example as a tension spring. The rod 40 is rotatably accomodated on the coach body at 50 as well as on the coupling frame 30 at 70 by means of bolts 51 and 71 respectively. In FIG. 1, the bellows section is telescoped; in order to keep the bellows section 30 in this position, a locking bar 80 is accomodated on the coach 60. Said locking bar 80 is cooperating with a bolt 81 accomodated on the bellows section in the area of the frame part 31 in such a way that the bellows section is kept telescoped.

The connection section also has the intercommunicating gangway section 10. Two gangway sections 10 may hereby be coupled so as to form a gangway (FIG. 3), whereas the gangway is encompassed by the bellows. The gangway section 10 as shown in FIG. 1 is tilted upwards, since the bellows 30 is shown telescoped in said FIG. 1.

Figure 2:
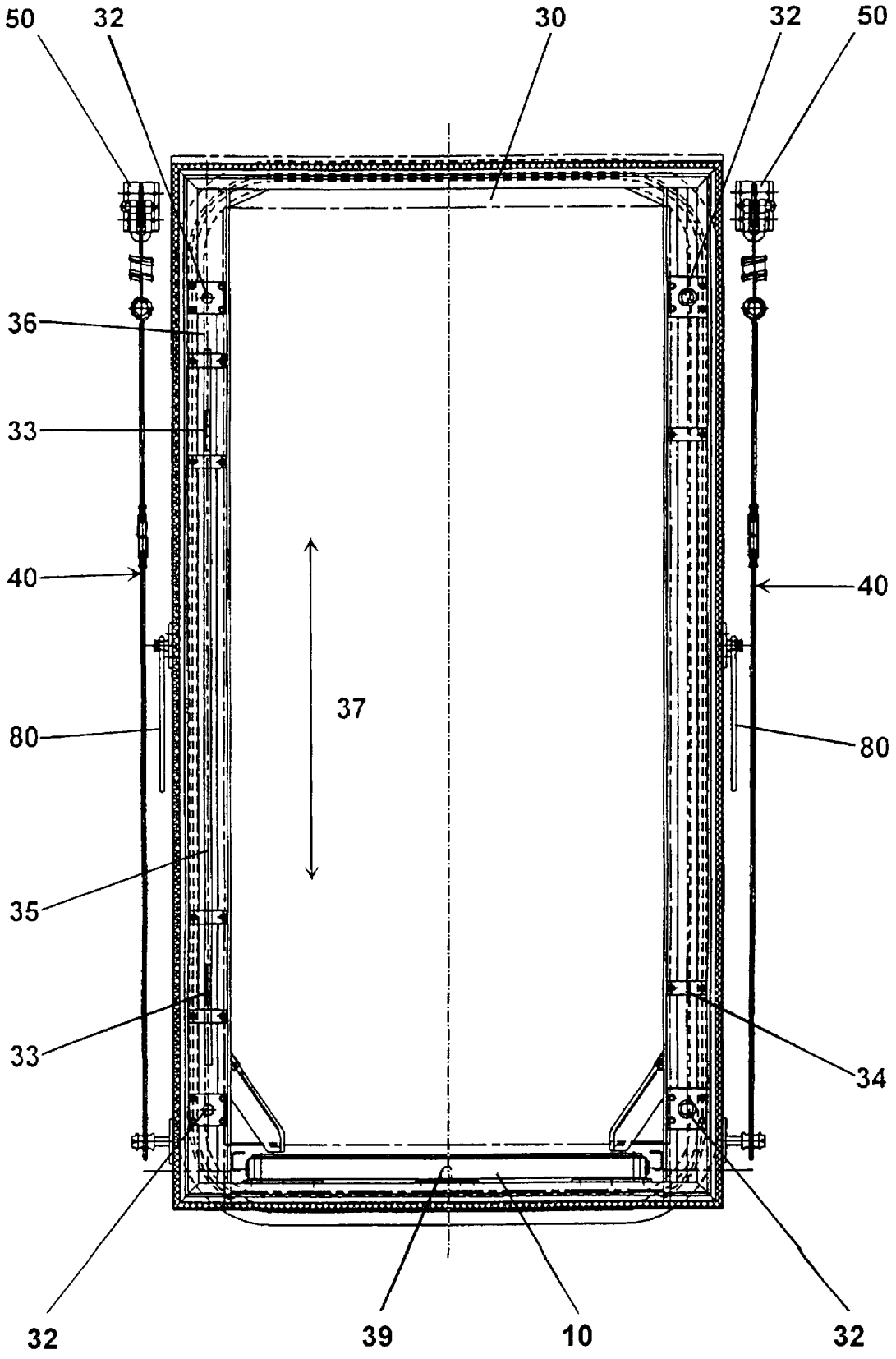
FIG. 2 is a front view of the one frame part of the central frame.

FIG. 2 is a front view of the coupling frame 31 of the central frame. The other coupling frame 31 is arranged mirror-inverted relative to the first coupling frame on the other bellows section and may be coupled with it so as to form the central frame. Each coupling frame 31 is provided on one of its longitudinal sides with centering pins 32 and hooks 33, whereas the hooks 33 are back-gripping a corresponding bracket 34 on the opposite frame part. The hooks 33 are actuated by a locking rod 35 which may be actuated by a cable pull 36. That means that, by sliding the locking rod in the direction of the arrow 37, the hook 33 is either locked with the bracket 34 or disengaged from the bracket 34.

Figure 3:
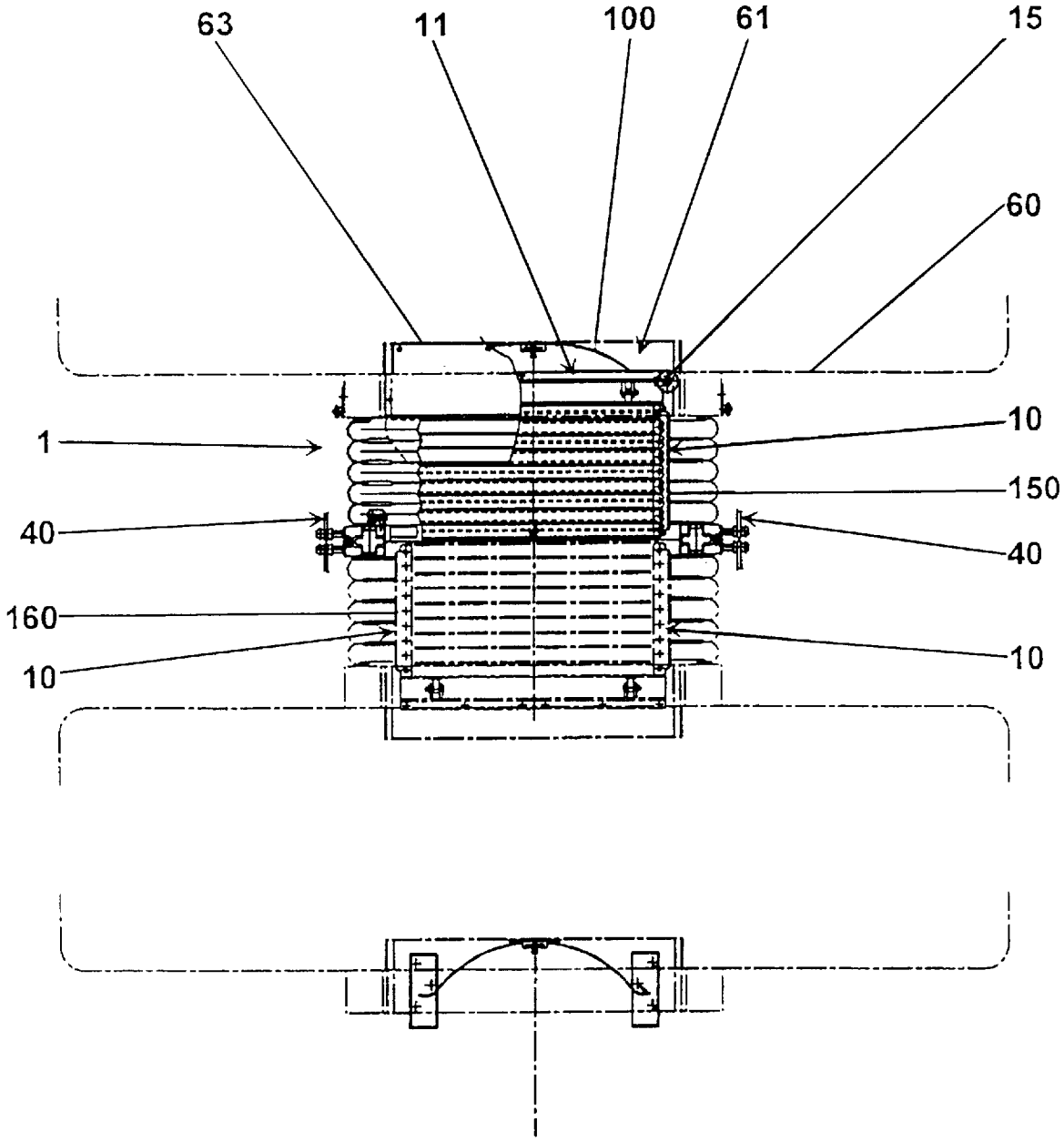
FIG. 3 is a top view of the connection.
Figure 4:
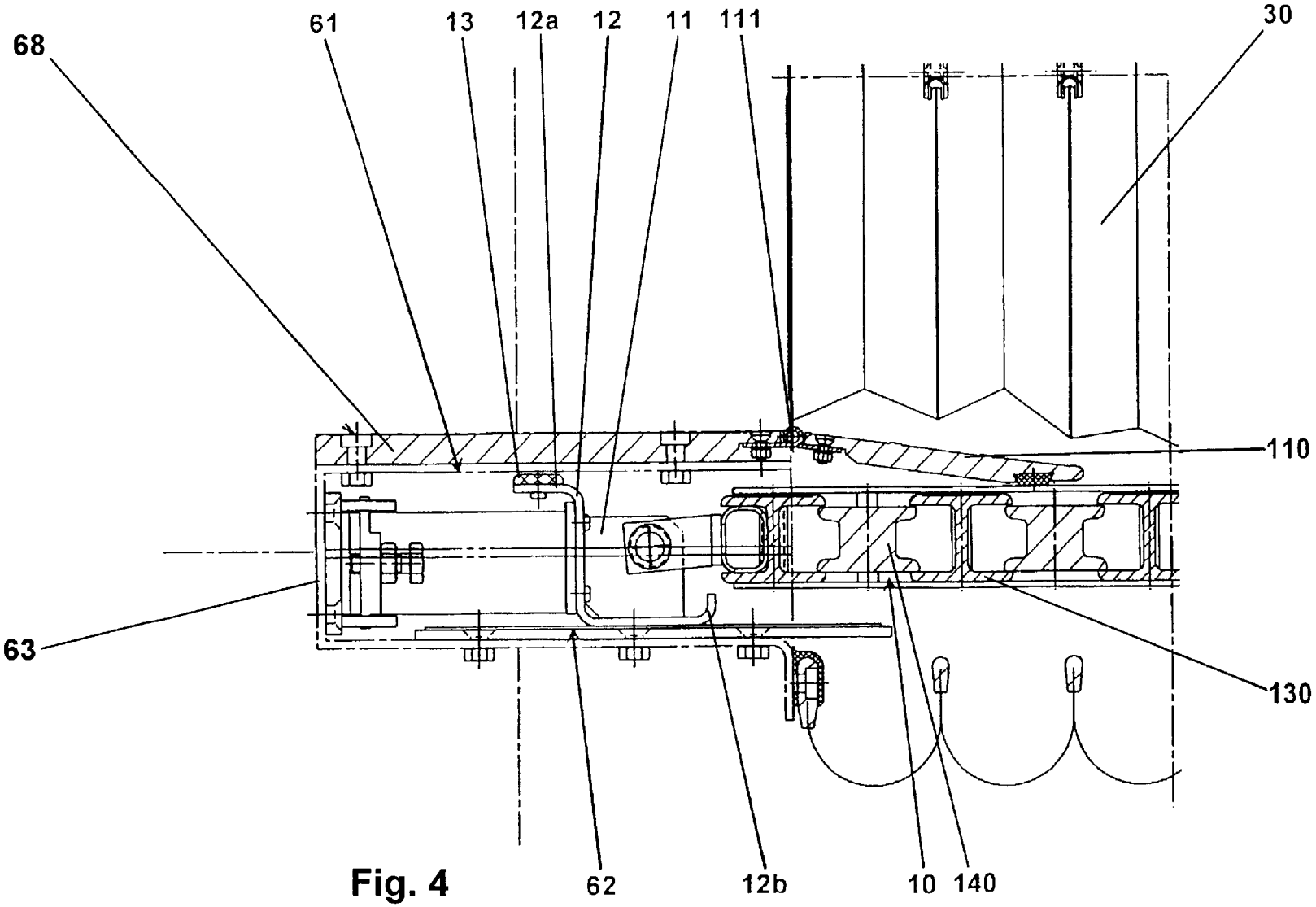
FIG. 4 shows an enlarged illustration of the accomodation of the gangway in the chamber of the vehicle.

The structure of the articulated gangway and the linking of the gangway sections 10 with the coach body may be seen in FIGS. 3 and 4. FIG. 4 particularly shows the linking of gangway section 10 with the vehicle part 60 in the chamber 61. That is how a cradle 11 is provided, said cradle being hinged to the gangway section 10. The cradle 11 is bedded in an approximately S-shaped corner 12 arranged in the chamber 61 of the vehicle part 60. The chamber 61 is located in the area of the vehicle part's (60) bottom. The corner 12 is provided on one of its legs 12*a* with a slide cushion 13. With its other leg 12*b* it rests on a gliding base 62 arranged on the bottom of chamber 61. As may particularly well be seen in FIG. 3, the cradle 11 is supported by a spring 100 relative to the rear wall 63 of the chamber. That means that, after excursion against the spring's 100 force, the cradle and with it the intercommunicating gangway is brought back to its original position by means of the spring's 100 force. The cradle itself is provided with rollers 15 arranged on a vertical axis and guiding laterally the cradle in the chamber 61. Accordingly, said rollers 15 are gliding alongside the lateral wall of chamber 61 and are preventing the cradle from jamming in the chamber. On the side of the articulated gangway section which lies opposite the cradle 11 the gangway section 10 is rotatably receivable by the coupling frame 31. That means that the coupling frame has two functions: it is coupling the two bellows sections together and it is carrying the articulated gangway. The articulated gangway is provided with a bearing shell 18 receiving a mandrel arranged in the bottom area of the coupling frame. The articulated gangway is thus kept centred and rotatable.

In the area of transition from the bottom 68 of the vehicle part 60 to the intercommunicating gangway 10 a ramp 110 is provided which covers the difference in level between the bottom 68 and the gangway section 10. The ramp 110 may be connected with the bottom 68 of the vehicle part 60 by means of the articulation 111.

The intercommunicating gangway and the two sections 10 of the intercommunicating gangway respectively are having gliding and stepping members 130, 140, which are accomodated in frame stretchers 150, 160 running parallel to the longitudinal axis of the vehicle so as to be longitudinally slidable relative to one another.

I claim:

1. Connection between two vehicles hinged to one another, said connection comprising a bellows and an intercommunicating gangway, said connection being divided transversely to the longitudinal axis of the vehicle into two connection sections, the one forming a bellows section and the other an intercommunicating gangway section with each connection section being held by traction means hinged on the coach body of the vehicle, characterized in that the intercommunicating gangway section is designed as an articulated gangway section having stepping and gliding members, with the gliding members being received by the stepping members so as to be slidable relative to said stepping members.

2. Connection according to claim 1 characterized in that the traction means (40) are arranged diagonally from the top of the coach (60) downwards to an underside of the bellows section and runs along a side wall of the bellows section on one of the connections or the coach (60).

3. Connection according to claim 2 characterized in that each side of the bellows section is provided with one of the traction means (40).

4. Connection according to claim 1, characterized in that the traction means (40) is designed as a rod.

5. Connection according to claim 3 characterized in that the length of the traction means is adjustable.

6. Connection according to claim 3, characterized in that the traction means (40) is provided with an elastic and flexible intermediate member (42).

7. Connection according to claim 1 characterized in that the bellows section (30) is coupled by a central frame comprising two coupling frames.

8. Connection according to claim 7 characterized in that the traction means is hinged on one of the coupling frames.

9. Connection according to claim 7 characterized in that the contracted bellows section (30) is tentered and fastened by a holding member (80, 81) when the central frame is separate.

10. Connection according to claim 1 characterized in that, when the connection is divided, the divided section (10) comprising the intercommunicating gangway section is tilted upward.

11. Connection according to claim 1 characterized in that the coach body (60) has a chamber (61) for the slidable reception of the intercommunicating gangway section.

12. Connection according to claim 11, characterized in that the intercommunicating gangway section (10) has a cradle (11) at its end which is slidably guided in the chamber (61).

13. Connection according to claim 12, characterized in that the cradle (11) is provided with rollers (15) ensuring the lateral guidance within the chamber (61).

14. Connection according to claim 13, characterized in that the cradle (11) is slidably guided in the chamber (61) against the force of a spring (100).

15. Connection according to claim 7 characterized in that the intercommunicating gangway section (10) is received rotatable by the coupling frame (31).

16. Connection according to claim 7 characterized in that the intercommunicating gangway section (10) is provided with a bearing shell (18) and that the coupling frame (31) has a mandrel (39) receiving the bearing shell.

* * * * *